US011988203B2

(12) United States Patent
Whitmore, Sr.

(10) Patent No.: US 11,988,203 B2
(45) Date of Patent: May 21, 2024

(54) MODULAR METERING PUMP SYSTEM

(71) Applicant: Brian S. Whitmore, Sr., Spring, TX (US)

(72) Inventor: Brian S. Whitmore, Sr., Spring, TX (US)

( * ) Notice: Subject to any disclaimer, the term of this patent is extended or adjusted under 35 U.S.C. 154(b) by 0 days.

(21) Appl. No.: 18/358,507

(22) Filed: Jul. 25, 2023

(65) Prior Publication Data

US 2024/0035465 A1 Feb. 1, 2024

Related U.S. Application Data

(60) Provisional application No. 63/453,727, filed on Mar. 21, 2023, provisional application No. 63/392,440, filed on Jul. 26, 2022.

(51) Int. Cl.

| | |
|---|---|
| ***F04B 49/00*** | (2006.01) |
| ***F04B 43/02*** | (2006.01) |
| ***F04B 43/12*** | (2006.01) |
| ***F04B 51/00*** | (2006.01) |
| ***F04B 53/16*** | (2006.01) |

(52) U.S. Cl.

CPC ..... *F04B 49/00* (2013.01); *F04B 43/12* (2013.01); *F04B 51/00* (2013.01); *F04B 43/02* (2013.01); *F04B 53/16* (2013.01)

(58) Field of Classification Search

CPC ..... F04B 49/00; F04B 43/12; F04B 51/00; F04B 53/16; F04B 43/02

See application file for complete search history.

(56) References Cited

U.S. PATENT DOCUMENTS

| | | | | |
|---|---|---|---|---|
| 5,727,933 | A | 3/1998 | Laskaris et al. | |
| 5,733,257 | A * | 3/1998 | Sternby | A61M 60/523 604/27 |
| 6,551,080 | B2 | 4/2003 | Anderson et al. | |
| 8,226,597 | B2 * | 7/2012 | Jacobson | A61M 5/172 604/67 |
| 8,313,701 | B2 | 11/2012 | Whitmore, Sr. | |
| 2005/0058548 | A1 | 3/2005 | Thomas et al. | |
| 2021/0239054 | A1 | 8/2021 | Reuter et al. | |
| 2021/0363979 | A1 * | 11/2021 | Fox | F04B 11/00 |

FOREIGN PATENT DOCUMENTS

| | | | | |
|---|---|---|---|---|
| CN | 212397567 U | * | 1/2021 | |
| WO | WO-2004038219 A1 | * | 5/2004 | F04B 13/00 |

* cited by examiner

*Primary Examiner* — Nathan C Zollinger
(74) *Attorney, Agent, or Firm* — Bradley Arant Boult Cummings LLP; Henry L. Ehrlich

(57) ABSTRACT

A metering pump system for supplying an aqueous chemical to a destination stock includes a first metering pump and a second metering pump connected to a common suction line and a common discharge line and operable to supply a desired chemical feed rate, an electronic flowrate sensor in communication with one of the common suction line and the common discharge line to measure an actual flowrate of the metering pump system, a controller in communication with the first metering pump, the second metering pump, and the electronic flowrate sensor, a control loop in use implemented by the controller to operate one or more of the first metering pump and the second metering pump to correct a deviation between the desired chemical feed rate and the actual flowrate measured by the electronic flowrate sensor.

20 Claims, 7 Drawing Sheets

MODULAR METERING PUMP SYSTEM

BACKGROUND

This section provides background information to facilitate a better understanding of the various aspects of the disclosure and is not an admission of prior art.

A metering pump is a positive displacement device for dispensing an aqueous solution via a calibrated cavity. As the fill and discharge cycle increases or decreases, the calibrated amount of fluid is forced under pressure to the application point. All metering pumps are calibrated using a calibration column to ensure accuracy. There are flow sensing devices that are used on metering pumps to indicate flow but not to control the pumping rate. The flow sensing devices are mostly used to show a flow and no-flow condition and, due to non-laminar pumping conditions, display unstable readings. Any time the back pressure on the pump discharge changes so does the calibration.

There are several different types and styles of metering pumps and metering pump systems available. These technologies utilize a calibrated diaphragm or cavity to draw, fill and expel aqueous solutions. Each system relies on a motor/gear reduction arrangement to operate the reciprocating cavity which controls the volume of dispensed solution. The driver motors employ a method of repeatable speed control to maintain a calibrated discharge flow capacity. To maintain the calibrated flowrate the pump must also operate against a stable fixed constant back pressure. This requires the pump to be tested regularly for accuracy by means of a physical volume calibration column. As the pump cavity equipment mechanically wears the amount of fluid transferred will change resulting in a reduction in flow accuracy. The diaphragm can also become gas bound. This occurs when the pumped fluid stock releases gas causing the pump to lose suction capability. This is a result of the single flow control function, that is the motor speed. Fluid passing through the metering pump cavity is assumed to be under constant control but is not confirmed with a calibration column or other calibration means therefore there is no absolute flow rate confirmation.

SUMMARY

An exemplary metering pump system for supplying an aqueous chemical to a destination stock includes a first metering pump and a second metering pump connected to a common suction line and a common discharge line and operable to supply a desired chemical feed rate, an electronic flowrate sensor in communication with one of the common suction line and the common discharge line to measure an actual flowrate of the metering pump system, a controller in communication with the first metering pump, the second metering pump, and the electronic flowrate sensor, a control loop in use implemented by the controller to operate one or more of the first metering pump and the second metering pump to correct a deviation between the desired chemical feed rate and the actual flowrate measured by the electronic flowrate sensor.

An exemplary method for controlling a chemical feed rate to a destination stock includes using a metering pump system to supply an aqueous chemical at a desired feed rate through a system discharge, the metering pump system including a first metering pump and a second metering pump connected to a system inlet and the system discharge and a flowrate sensor connected to one of the system inlet or the system discharge, operating the metering pump at a calibrated feed rate corresponding to the desired feed rate, obtaining with the flowrate sensor an actual feed rate of the first metering pump while operating at the calibrated feed rate, determining a deviation between the actual feed rate and the desired feed rate, and changing, in response to the deviation, a pump speed of the first metering pump to achieve the desired feed rate.

Another exemplary method for controlling a chemical feed rate to a destination stock includes operating a metering pump system to supply an aqueous chemical at a desired feed rate to through a system discharge, the metering pump system having a first metering pump and a second metering pump connected to a system inlet and a system discharge, a flowrate sensor in one of the system inlet or the system discharge, and a controller in communication with the first metering pump, the second metering pump, and the flowrate sensor, operating one or more of the first metering pump and the second metering pump at a calibrated feed rate corresponding to the desired feed rate, measuring an actual feed rate of the metering pump system with the flowrate sensor, and the controller implementing a control loop to change a pump speed of the one or more of the first metering pump and the second metering pump to correct a deviation between the actual feed rate and the desired feed rate.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
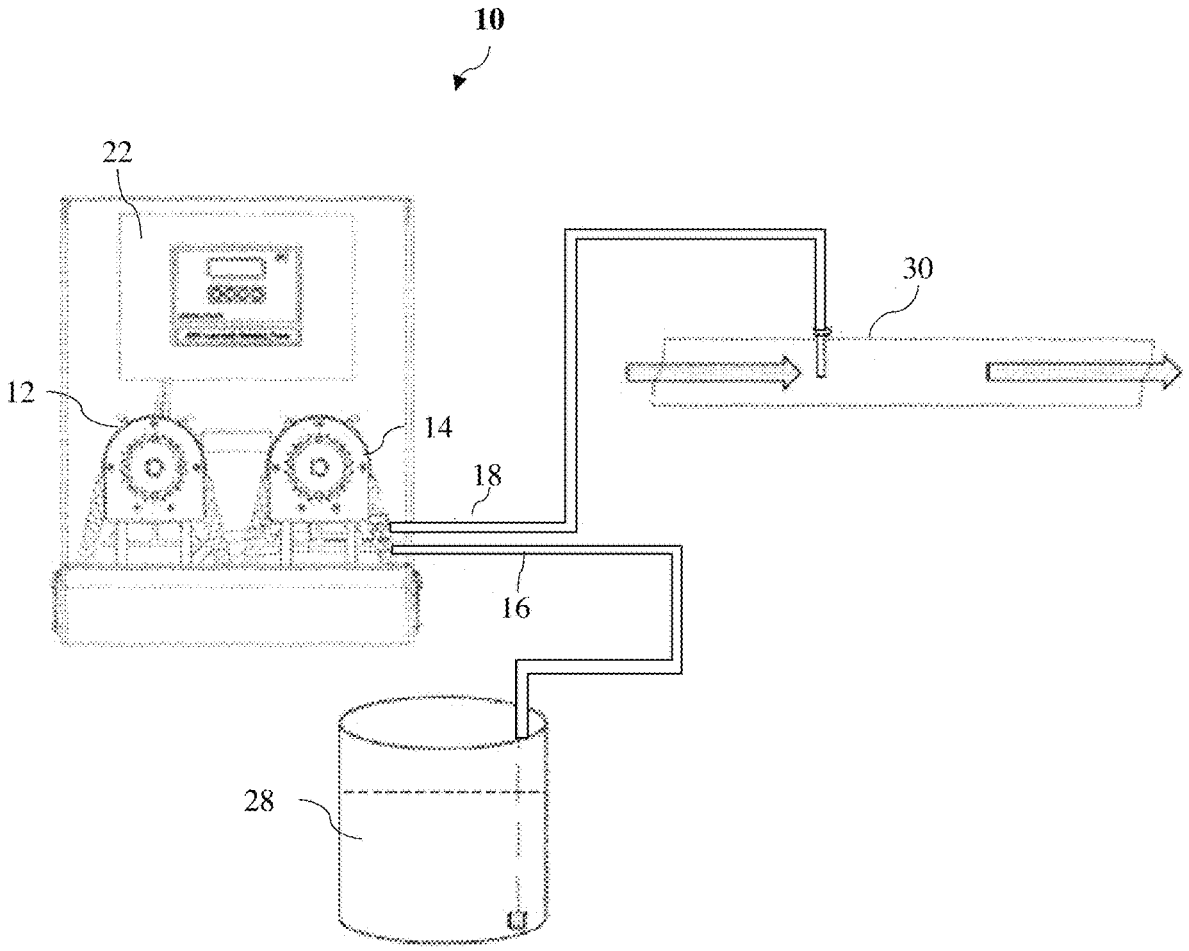
FIG. 1 illustrates an exemplary metering pump system supplying an aqueous chemical at a desired feed rate to a water source to be treated by the chemical.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

An exemplary metering pump system is a modular system with one or more metering pumps that are controlled using the internal pump speed set by a controller. Exemplary metering pumps include peristaltic, diaphragm, piston, and gear pumps. Exemplary pump capacities are 0-gallons per day (GPD), 0-250 GPD, and 0-500 GPD. One exemplary pump uses a roller and a tube to force the liquid twice per revolution. The controller can adjust the rotational speed from 1 to 120 RPM. As the pump rotates the same amount of fluid will be dispensed for each revolution. The discharged volumes vary with tube and roller size. A second form of control is an electronic flow sensor that measures the flow. Any deviation from the calibrated output of the pump will be sensed by the flow sensor. The sensor's output will be connected to the controller and slow down or speed up the pump to maintain the calibrated rate. The flow sensor may be used to regulate the amount of fluid that the pump puts out regardless of cavity condition or back pressure.

The flow sensor measures the fluid flow rate in the system suction or the system discharge and sends a signal proportional to the actual feed to the pump controller, the controller adjusts to the set point and output of the sensor, maintaining an accurate feed rate.

If air is present in the fluid system, the flow sensor will detect it and cause the flow sensor reading to drop. This will cause a deviation between the flow sensor and set point. The pump will then speed up to displace the air. Once fluid is flowing again, the system will continue to control.

If for a period of time the injection fluid does not increase to the desired (set) feed rate, a fault will occur and switch to a backup pump. If for a reason the backup fails to dispense fluid at the desired feed rate the system will provide a fault that will be picked up by the operator.

Other pump systems do not do this. The reason being that all pumps operate on a plug flow arrangement. Meaning that they cannot obtain a stable reading good enough for fine control as achieved by configurations disclosed herein.

By incorporating the electronic signal from the flow sensor, several other functions can be achieved. Accuracy of the fluid being fed can be maintained as the tube or diaphragm wears. This is a condition where the calibrated feed rate in normal conditions is always needing to be corrected. Normally, a physical drawdown will need to be performed to adjust feed and ensure accuracy. Incorporating the flow sensor output as a trim, the need for constant manual verification is no longer required. Since the actual fluid is being measured and its output signal is part of the control scheme, loss of feed can be determined by adjustable deviation. As the feed drops the flow sensor output will call for the pump to dispense more fluid. The controller will measure the deviation between desired and actual feed. An adjustable deviation setpoint can be set to shut down the faulting pump and start the standby pump. Both pumps utilize a common flow sensor that is mounted on either the suction or discharge line. When the second pump is brought online it will control at the same values as the first pump. In the situation when a pump fails, a relay will either open or close that can be hooked up to an external device to alert responsible personnel of a problem. This problem can be either flow, mechanical or electrical in nature. The duplex pump system, because of the common flow sensor, can be operated in a mode where both pumps can be staged where the first pump will feed up to 100 percent and hold, then the second pump can ramp up and eventually double the output. The duplex system may have an internal timer in the controller to alternate between the two or more pumps with intervals up to, for example, 168 hours. This feature allows for equal run time without human intervention.

Figure 2:
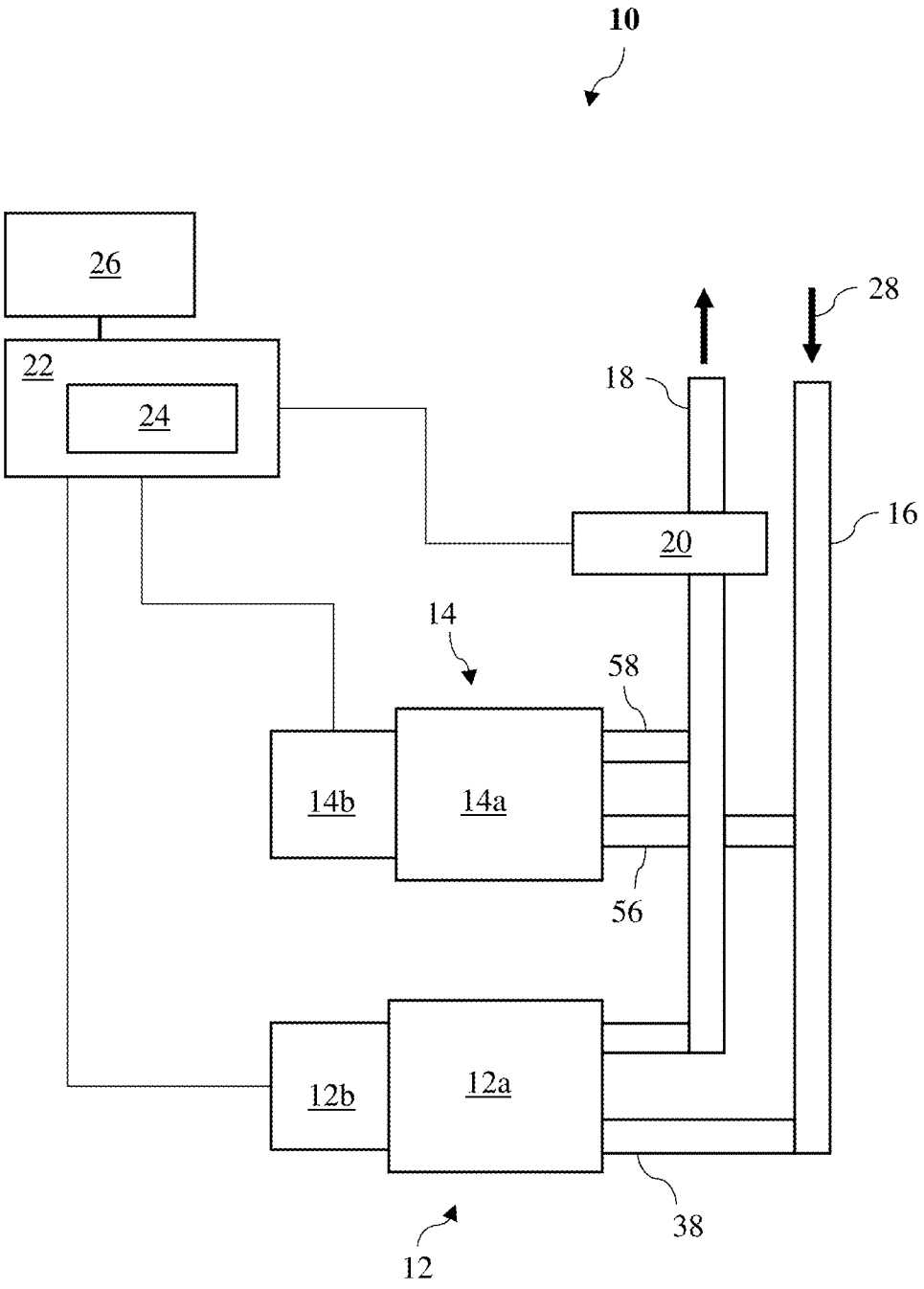
FIG. 2 is a schematic illustration of a modular metering pump according to one or more aspects of the disclosure.

FIGS. 1 and 2 illustrate an exemplary metering pump system generally denoted by the numeral 10 to supply an aqueous chemical to a destination stock. In this example, metering pump system 10 is arranged as a modular duplex pump system. Metering pump system 10 includes a first metering pump 12 and second metering pump 14 connected between a common suction line 16 and common discharge line 18. Metering pumps 12, 14 each have a respective pump head 12*a*, 14*a* and a respective driver 12*b*, 14*b* each with pump controllers (e.g., motor controls). Drivers 12*b*, 14*b* may be electrically powered. For example, an electric motor or solenoid. An electronic flowrate sensor 20 is connected in one of the common suction line 16 or the common discharge line 18. Flowrate sensor 20 is shown in common discharge line 18. A main controller 22 is in communication with pumps 12, 14, for example via drivers 12*b*, 14*b*. Main controller 22 includes a processor and memory storing computer-executable instructions 24 for controlling the processor. Metering system 10 is connected to an electrical power source 26, which may include a back-up power supply. Suction, or inlet, line 16 is in communication with an aqueous chemical 28 and the discharge line 18 is in communication with a destination stock 30 illustrated as a water main.

Figure 3:
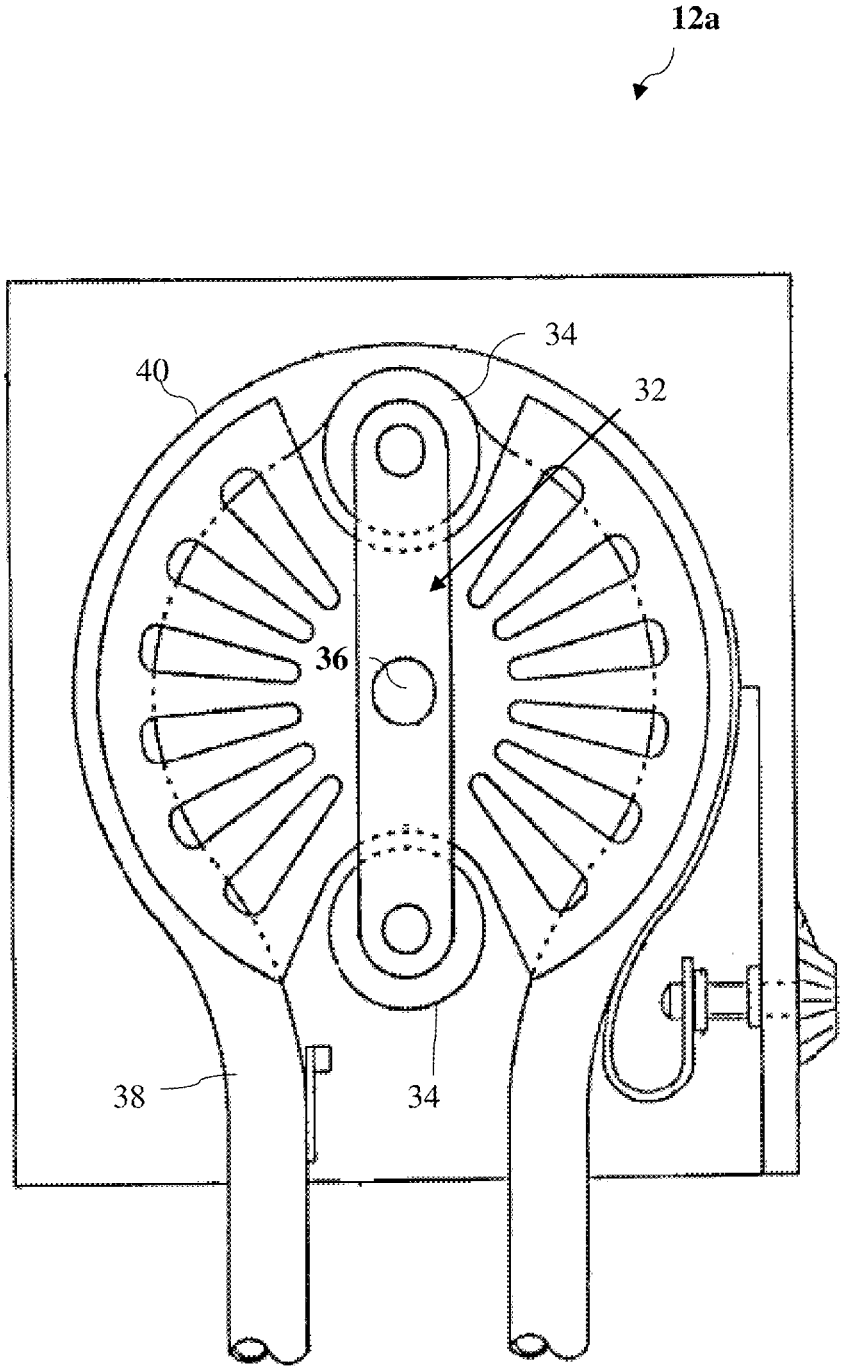
FIG. 3 illustrates an exemplary pump head of an exemplary metering pump.

FIG. 3 illustrates an exemplary pump head 12*a* for a peristaltic pump. Pump head 12*a* is described in detail in U.S. Pat. No. 6,551,080, the teachings of which are incorporated herein by reference. With additional reference to FIG. 2, pump head 12*a* has a rotor arm 32 with a roller 34 mounted on the opposing ends of rotor arm 32. Rotor arm 32 is mounted on a drive shaft 36 driven by an electric motor 12*b*. Pump head 12*a* includes a tube 38 connected to system suction line 16 and system section line 18. Tube 38 is positioned along an arcuate surface 40 of pump head 12*a* along an arc of travel of rollers 34. The internal cavity of tube 38 along the arcuate surface provides a calibrated volume. In this example, each revolution of rotor arm 32 causes each roller 34 to compress the tube and discharge the calibrated volume of fluid to the common discharge line and draw a calibrated volume of fluid into the pump from the common suction line.

Figure 4A:
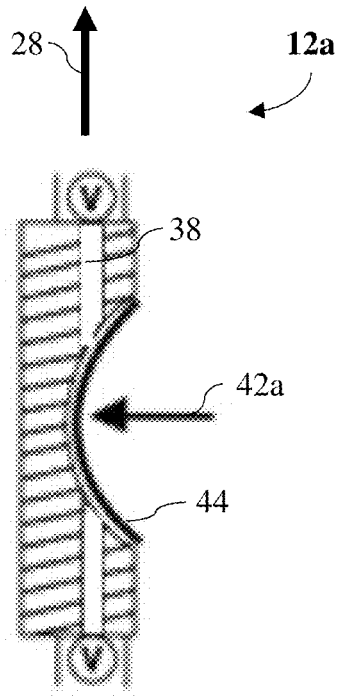
FIGS. 4A, 4B illustrate another exemplary pump head of an exemplary metering pump.
Figure 4B:
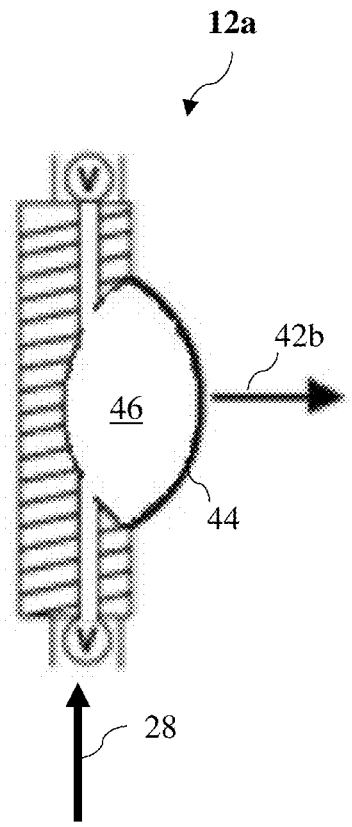

FIGS. 4A and 4B schematically illustrate a diaphragm pump head 12*a* having a conduit 38 or tube in communication with a diaphragm. FIG. 4A illustrates a first pump stroke 42*a* compressing diaphragm 44 discharging the aqueous chemical 28 from pump head 12*a*. FIG. 4B illustrates the return pump stroke 42*b* drawing aqueous chemical 28 into the cavity 46.

Figure 5:
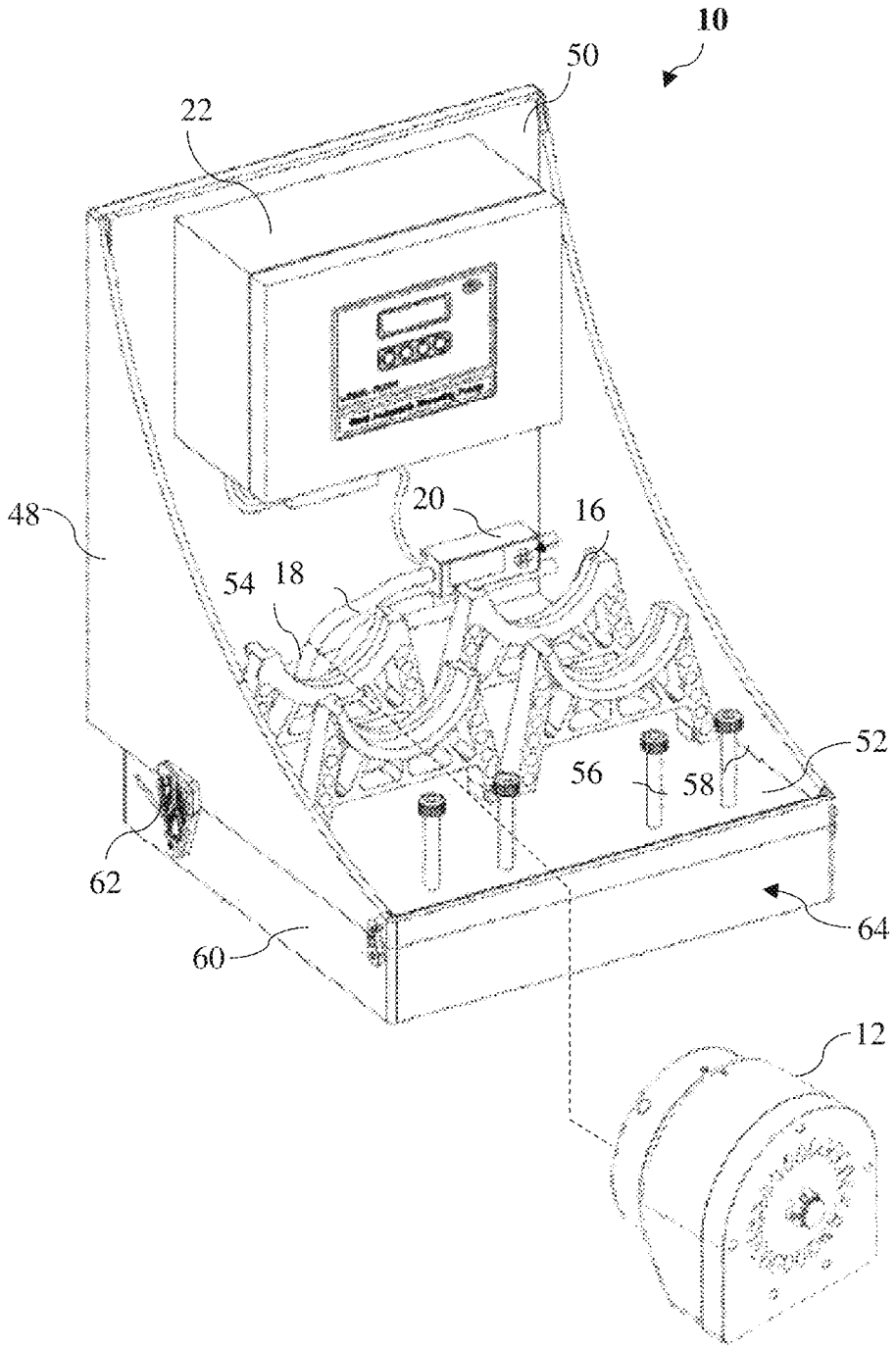
FIG. 5 illustrates an exemplary modular metering pump system according to one or more aspects of the disclosure.

FIG. 5 illustrates an exemplary modular duplex metering pump system 10. System 10 includes a housing 48 including a vertical mounting panel 50 and a horizontal floor 52. Controller 22 is attached to vertical mounting panel 50. A pump mount 54 for each pump is attached to horizontal floor 52. In this example, system 10 has two pump mounts 54. Positioned forward of each pump mount 54 relative to vertical panel 50 are pump inlet 56 and pump discharge 58 (see, FIG. 2) tubing that connect pump 12 (e.g., conduit 38) to the common suction line 16 and common discharge 18. Flow sensor 20 is connected to one of common suction line 16 or discharge line 18. A cover 60 is removably coupled via latches 62 to floor 52 opposite from pump mounts 54 to enclose a chamber 64 disposing for example system tubing and wiring.

Figure 6:
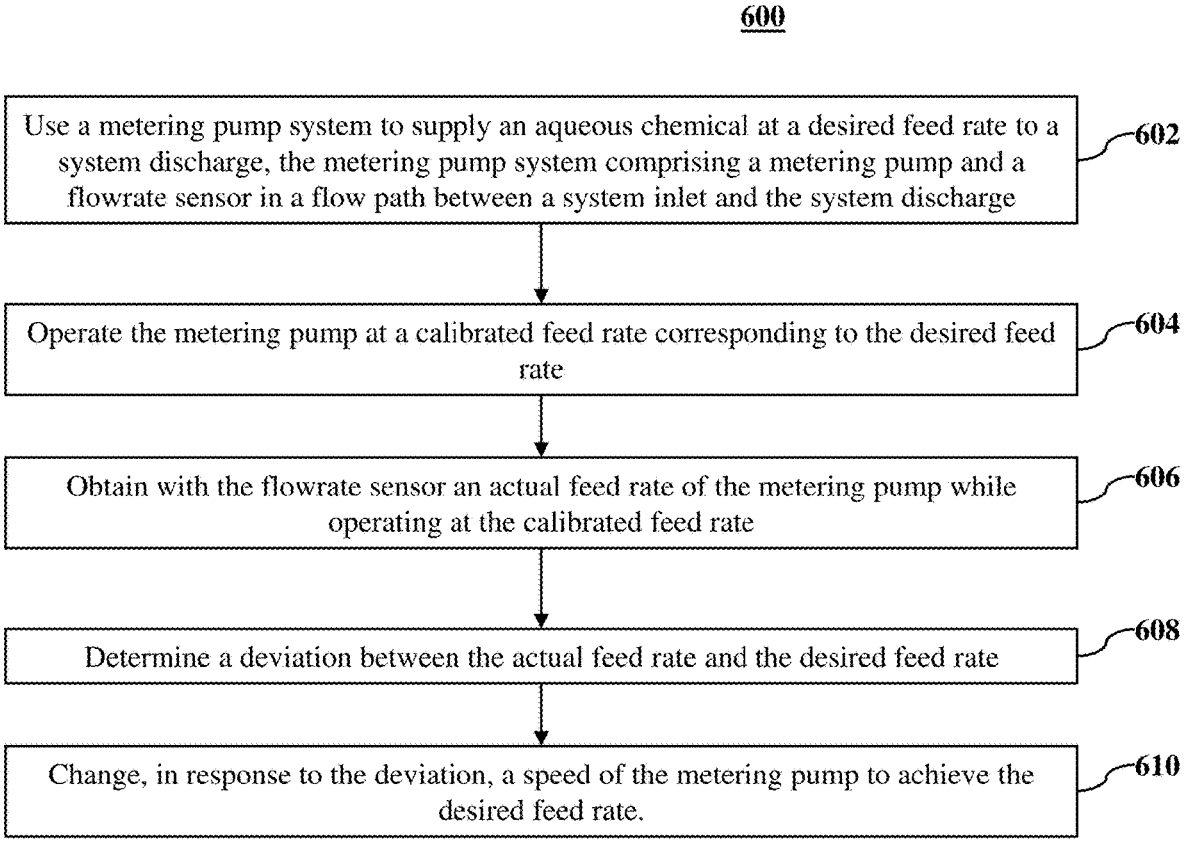
FIG. 6 is a block illustration of an exemplary method according to one or more aspects of the disclosure.

FIG. 6 is a graphical illustration of an exemplary method 600 for controlling a chemical feed rate to a destination stock, which is described with reference to FIGS. 1-2. At block 602 a metering pump system 10 is used to supply an aqueous chemical 28 at a desired feed rate to a system discharge 18 and destination stock 30. Metering pump system 10 includes a metering pump 12 and a flowrate sensor 20 in a flow path between system inlet 16 and system discharge 18. The flow path is the one or more pumps, e.g., conduit or tube 38. At block 604, the metering pump is operated at a calibrated feed rate corresponding to the desired feed rate for the treatment scenario. The calibrated feed rate is controlled by the pump speed. At block 606, the flowrate sensor measures the actual feed rate of the system in one of the system inlet 16 or system discharge 18. At block 608, a deviation is determined, for example by a controller, between the actual feed rate and the calibrated feed rate (set to the desired feed rate). At block 610, in response to a deviation, changing the speed of the metering pump to eliminate the deviation and achieve the desired feed rate.

Figure 7:
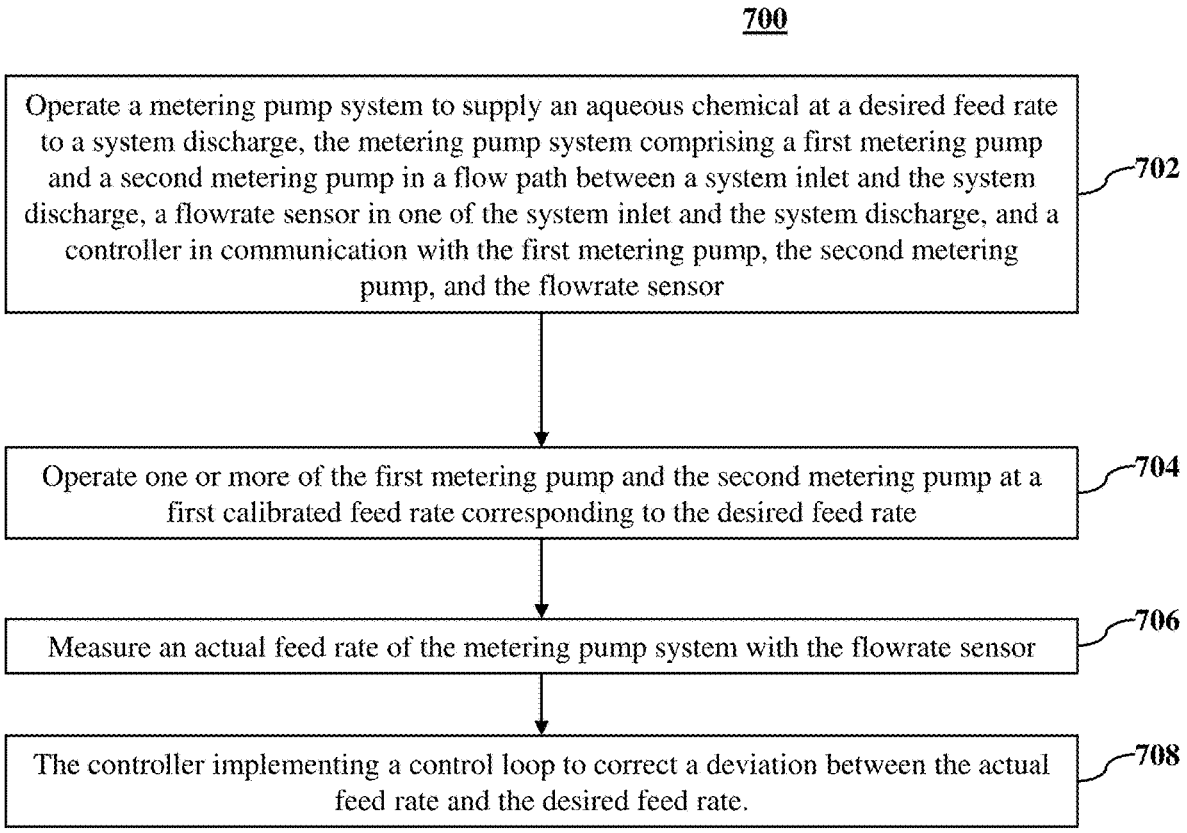
FIG. 7 is a block illustration of an exemplary method according to one or more aspects of the disclosure.

FIG. 7 is a graphical illustrating of another exemplary method 700 for controlling a chemical feed rate to a destination stock 30. At block 702, a metering pump system 10 is operated to supply an aqueous chemical 28 at a desired feed rate to a system discharge 18. The metering pump system includes a first metering pump 12 and a second metering pump 14 in the flow path between the system inlet and the system outlet, a flowrate sensor is in one of the system inlet and the system discharge, and a controller is in communication with the first and second pumps and the flowrate sensor. At block 704, one or more of the pumps 12, 14 are operated at a calibrated feed rate corresponding to the desired feed rate. At block 706, an actual flow rate is measured in one of the common inlet 16 and common discharge 18 with the flowrate sensor. At block 708, the controller corrects a deviation between the actual feed rate and the desired feed rate using a control loop to change a speed of the one or more of the metering pumps that is operating.

The control scenario for the exemplary modular metering pump system has two main components. The metering pumps utilize motor speed control as a primary means of calibration and the speed control utilizes a feedback loop from electronic flow sensor 20. These two signals are transmitted to controller 22. Controller 22 combines the two signals, motor speed and flow sensor, and supplies a controlling output signal to the metering pump motor.

The speed control signal from the pump and feedback loop signal from the electronic flow sensor are conditioned and weighted within system controller 22. These two signals are adjusted to provide a 0-100 percent combined weighted driver signal to the metering pump system. An exemplary mode of operation follows. The metering pumps are set up for a maximum feed rate provided on the flow sensor display. During unit installation a starting control calibration setting will be placed on each individual pump; 0, 20, 50, and 80% of set range. The pumps are now calibrated for their respective ranges. Once a selected pump is set for a desired feed rate that pump is started. Initially the pump will base its feed rate off the speed of the motor only. After 15 seconds the feedback signal from the flow sensor will be added automatically to the pump motor control loop. As the suction or discharge pressures change, the flow sensor will see this deviation and correct the motor speed to the desired rate. If the desired feed rate cannot be maintained the primary pump will stop, the secondary pump will start and continue to feed at the desired rate. This operational condition is accomplished by a deviation rate function and timer in the controller. The deviation rate function is set for example to allow the feed rate to vary between 1 and 10 percent of the calibrated rate. The timer is adjustable between 1 and 999 seconds. This timer function allows the pump to correct itself to the proper output volume setting.

There may be a timer function within the controller that will automatically toggle between the first and second pumps to provide equal run time thus reducing excess wear on the pump diaphragms or tubes.

There are four specific control parameter adjustments that are incorporated into the speed and flow input signals. With regard to the pump, there is proportional gain, which is the amount of correction to the pump speed required for correct speed deviation; integral gain, which is the duration of correction to the pump speed for correct speed deviation; motor/pump speed gain, which is percentage control in the speed control signal from the pump; and dead band, which is a parameter in which the speed will not adjust within a set percentage of the target feed rate.

Control parameter adjustments regarding the electronic flow sensor include proportional gain, which is the amount of correction from the flow sensor to correct for pump throughput variation; integral gain, which is the duration of the corrective change of the flow sensor to correct the pump flow deviation throughput; flow sensor gain, which is percentage control in the output signal to the pump; and flow sensor dead band, which is the amount of deviation where the flow output signal will not take corrective action.

In an exemplary configuration, the pump will use both motor speed and a portion of the flow sensor output to maintain an accurate feed rate. A deviation from the desired feed rate results in the controller automatically adjusting the pump speed appropriately. If the feed chemical releases gas, the flow sensor will sense this change. The decreased throughput will cause the pump motor to increase speed until proper flow is reestablished at which time the pump will adjust to control at the desired rate.

In an exemplary configuration, the pump will automatically correct to the control set point feed rate regardless of varying back pressure and/or suction head pressure because the device is looking at pump speed and actual flow throughput. This arrangement does not require constant manual physical calibration verification, the flow accuracy is confirmed by the flowrate sensor. This pump configuration will automatically correct to the desired feed rate caused by pump cavity equipment wear.

An exemplary system is a duplex configuration wherein the controller will automatically switch from the primary pump to the secondary pump in the event the primary pump will not maintain the control set point feed rate. The exemplary controls provide a relay that trigger an alarm when the primary pump switches to the backup pump to provide an alert signal that there was a fault with the primary pump.

The system controls can be set to allow for lead/lag operation. If the primary pump maintains a feed rate of 100 percent capacity for a set time period, the controller will toggle the second pump into service. The primary pump will reduce operating speed to 50 percent and the secondary pump will increase speed to combine the two pumps for the additional 50 percent to maintain the required feed rate. This operational arrangement is designed to reduce pump hardware wear.

The metering pump system may function in three modes. Local fixed set point mode from a remote input and from two combined input modes. "Fixed set point mode" where the pumps are locally set to a fixed feed rate. "Remote input mode" is where the controller receives a remote variable input signal which automatically adjusts the pump throughput to maintain an externally required feed rate. The "two remote inputs mode" allows for a second remote input signal for further adjustment to the pump module throughput such as an analyzer or another form of sensor. For example, the first remote input would adjust pump throughput based on a change in remote feed rate requirements. The second remote input would allow for further tuning the feed rate results when added to the first remote input.

The metering pump system controls operate on 24 vdc. Controller design provisions allow for a system battery backup and solar panel configurable operations. This allows the system to be designed with a solar panel arrangement which would include a backup battery set for 24-hour operation. A 24 vdc 7.5 amp-hour battery will allow up to 8 hours continuous operation.

Although relative terms such as "outer," "inner," "upper," "lower," and similar terms have been used herein to describe a spatial relationship of one element to another, it is understood that these terms are intended to encompass different orientations of the various elements and components in addition to the orientation depicted in the figures. Furthermore, as used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. The terms "substantially," "approximately," "generally," and "about" are defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for controlling a chemical feed rate to a destination stock, the method comprising:

using a metering pump system to supply an aqueous chemical at a desired feed rate through a system discharge, the metering pump system comprising:

a housing having a floor extending horizontally forward from a vertical panel;

a first mount supporting a first metering pump above the floor;

a second mount supporting a second metering pump above the floor;

a system inlet and the system discharge located aft of the first mount and the second mount;

a first inlet conduit connected to the first metering pump forward of the first mount, extending through the floor, and connected to the system discharge aft of the first mount;

a second inlet conduit connected to the second metering pump forward of the second mount, extending through the floor, and connected to the system discharge aft of the second mount;

a first outlet conduit connected to the first metering pump forward of the first mount, extending through the floor, and connected to the system discharge aft of the first mount;

a second outlet conduit connected to the second metering pump forward of the second mount, extending through the floor, and connected to the system discharge aft of the second mount; and a flowrate sensor in one of the system inlet or the system discharge;

operating the first metering pump at a calibrated feed rate corresponding to the desired feed rate;

obtaining with the flowrate sensor an actual feed rate of the metering pump system while operating at the calibrated feed rate;

determining a deviation exists between the actual feed rate and the desired feed rate; and changing, in response to the deviation, a pump speed of one or both of the first metering pump and the second metering pump to substantially achieve the desired feed rate.

2. The method of claim 1, wherein the first metering pump is a peristaltic pump.

3. The method of claim 1, wherein the first metering pump is a diaphragm pump.

4. The method of claim 1, wherein the deviation is a difference greater than a selected value between the actual feed rate and the desired feed rate.

5. The method of claim 1, wherein the flowrate sensor is connected in the system discharge.

6. The method of claim 1, wherein the flowrate sensor is connected in the system inlet.

7. The method of claim 1, wherein the system inlet is positioned in a supply of the aqueous chemical.

8. The method of claim 1, wherein the system inlet is positioned in a supply of the aqueous chemical and the system discharge is at a water source.

9. The method of claim 1, wherein:

the first metering pump and the second metering pump are peristaltic pumps; and the deviation is a difference greater than a selected value between the actual feed rate and the desired feed rate.

10. The method of claim 1, further comprising a cover removably coupled to the floor opposite from the first metering pump and the second metering pump to enclose a chamber.

11. A method for controlling a chemical feed rate to a destination stock, the method comprising:

operating a metering pump system to supply an aqueous chemical at a desired feed rate through a system discharge, the metering pump system comprising:

a housing having a floor extending horizontally forward from a vertical panel;

a first mount supporting a first metering pump above the floor;

a second mount supporting a second metering pump above the floor;

a system inlet and the system discharge located aft of the first mount and the second mount;

a first inlet conduit connected to the first metering pump forward of the first mount, extending through the floor, and connected to the system discharge aft of the first mount;

a second inlet conduit connected to the second metering pump forward of the second mount, extending through the floor, and connected to the system discharge aft of the second mount;

a first outlet conduit connected to the first metering pump forward of the first mount, extending through the floor, and connected to the system discharge aft of the first mount;

a second outlet conduit connected to the second metering pump forward of the second mount, extending through the floor, and connected to the system discharge aft of the second mount;

a flowrate sensor in one of the system inlet or the system discharge; and a controller in communication with the first metering pump, the second metering pump, and the flowrate sensor;

operating one or more of the first metering pump and the second metering pump at a calibrated feed rate corresponding to the desired feed rate;

measuring an actual feed rate of the metering pump system with the flowrate sensor; and the controller implementing a control loop to change a pump speed of the one or more of the first metering pump and the second metering pump to correct a deviation between the actual feed rate and substantially achieve the desired feed rate.

12. The method of claim 11, further comprising the controller switching operating the first metering pump to operating the second metering pump in response to the first metering pump failing to supply the desired feed rate after a time period.

13. The method of claim 11, wherein the operating metering pump system at the calibrated feed rate comprises operating the first metering pump and the second metering pump.

14. The method of claim 11, wherein the implementing a control loop comprises combining a pump speed signal of the one or more of the first metering pump and the second metering pump and a feedback signal from the flowrate sensor and communicating a controlling output signal to the one or more of the first metering pump and the second metering pump.

15. The method of claim 11, wherein the first metering pump and the second metering pump are one of a peristaltic pump or a diaphragm pump.

16. A metering pump system for supplying an aqueous chemical at a desired feed rate to a destination stock, the metering pump system comprising:

a housing having a floor extending horizontally from a vertical panel;

a first pump mount extending above the floor;

a second pump mount extending above the floor adjacent to the first pump mount;

a common suction line positioned aft of the first pump mount and the second pump mount;

a common discharge line positioned aft of the first pump mount and the second pump mount;

a first metering pump on the first pump mount;

a first inlet conduit connected to the first metering pump forward of the first pump mount, extending through the floor, and connected to the common suction line aft of the first pump mount;

a first outlet conduit connected to the first metering pump forward of the first pump mount, extending through the floor, and connected to the common discharge line aft of the first pump mount;

a second metering pump on the second pump mount;

a second inlet conduit connected to the second metering pump forward of the second pump mount, extending through the floor, and connected to the common suction line aft of the second pump mount;

a second outlet conduit connected to the second metering pump forward of the second pump mount, extending through the floor, and connected to the common discharge line aft of the second pump mount;

an electronic flowrate sensor connected in one of the common suction line or the common discharge line to measure an actual flowrate of the metering pump system and to generate a flow rate signal indicative of the actual flowrate; and a controller mounted on the vertical panel for controlling the first metering pump and the second metering pump, the controller causing adjustments to a speed of one or more of the first metering pump and the second metering pump as a function of the flow rate signal whereby the desired feed rate is substantially achieved.

17. The metering pump system of claim 16, wherein the first metering pump is a diaphragm pump.

18. The metering pump system of claim 16, wherein the first metering pump is a peristaltic pump.

19. The metering pump system of claim 18, further comprising a cover removably coupled to the floor opposite from the first metering pump and the second metering pump to enclose a chamber.

20. The metering pump system of claim 18, wherein the first metering pump has a pump capacity of about 0 to 250 gallons per day.

* * * * *